US007574981B1

(12) United States Patent
Schulz

(10) Patent No.: US 7,574,981 B1
(45) Date of Patent: Aug. 18, 2009

(54) APPARATUS AND METHOD FOR IMPROVING THE DURABILITY OF A COOLING TUBE IN A FIRE TUBE BOILER

(75) Inventor: Clinton J. Schulz, Corpus Christi, TX (US)

(73) Assignee: Citgo Petroleum Corporation, Houston, TX (US)

( * ) Notice: Subject to any disclaimer, the term of this patent is extended or adjusted under 35 U.S.C. 154(b) by 33 days.

(21) Appl. No.: 11/543,572

(22) Filed: Oct. 5, 2006

(51) Int. Cl.
*F28F 19/00* (2006.01)

(52) U.S. Cl. ..... 122/512; 122/235.12; 165/134.1

(58) Field of Classification Search ..... 122/7 R, 122/42, 44.1, 235.11, 235.12, 512; 165/134.1, 165/76; 427/230, 376.7
See application file for complete search history.

(56) References Cited

U.S. PATENT DOCUMENTS

| | | | | | |
|---|---|---|---|---|---|
| 883,147 | A | | 3/1908 | Root | |
| 975,612 | A | | 11/1910 | Galbraith | |
| 1,102,163 | A | | 6/1914 | Opperud | |
| 2,092,358 | A | | 9/1937 | Robertson | |
| 3,317,222 | A | | 5/1967 | Maretzo | |
| 3,707,186 | A | * | 12/1972 | Zorrilla et al. | 165/134.1 |
| 3,769,489 | A | | 10/1973 | Charlesworth | |
| 4,066,861 | A | | 1/1978 | Broodman | |
| 4,152,818 | A | | 5/1979 | Mort et al. | |
| 4,221,263 | A | | 9/1980 | Meyer | |
| 4,254,819 | A | * | 3/1981 | Worrell | 165/134.1 |
| 4,482,415 | A | | 11/1984 | Mort et al. | |
| 4,528,733 | A | | 7/1985 | Lord | |
| 4,607,689 | A | * | 8/1986 | Mochida et al. | 165/110 |
| 5,246,063 | A | * | 9/1993 | Fix et al. | 165/134.1 |
| 5,647,432 | A | * | 7/1997 | Rexford et al. | 165/134.1 |
| 5,775,269 | A | * | 7/1998 | Lawrence | 122/511 |
| 6,173,682 | B1 | * | 1/2001 | Parnell et al. | 122/512 |
| 6,254,930 | B1 | * | 7/2001 | Kreiselmaier | 427/239 |
| 6,827,375 | B2 | * | 12/2004 | Fraser | 285/258 |
| 6,871,774 | B2 | | 3/2005 | DeSalve | |
| 6,960,333 | B2 | * | 11/2005 | Blanda et al. | 423/376 |
| 7,252,138 | B2 | * | 8/2007 | Burkhalter et al. | 165/76 |

FOREIGN PATENT DOCUMENTS

| | | |
|---|---|---|
| WO | WO 97/27425 | 7/1997 |

* cited by examiner

*Primary Examiner*—Gregory A Wilson
(74) *Attorney, Agent, or Firm*—McAfee & Taft

(57) ABSTRACT

An apparatus and method for improving the longevity of a cooling tube in a fire tube boiler. The apparatus comprises a ferrule inserted within the cooling tube end and an internal overlay, with the ferrule and internal overlay arranged to provide a smooth, continuous, and diverging passage that reduces turbulence for a heated fluid flowing therethrough, thus preventing the overheating of the tube wall in the highly turbulent area. The internal overlay may be a weld overlay of a corrosion-resistant material that is deposited in a band about the inner wall of the cooling tube, the overlay having an annular inner recess receiving the end of the ferrule. The combination of ferrule and internal overlay also reduces the sharp gradient in temperature that is encountered when the heated fluid enters the relatively cool tube end, thus reducing film boiling, reducing cracking of the tube end, and enhancing corrosion resistance.

1 Claim, 3 Drawing Sheets

APPARATUS AND METHOD FOR IMPROVING THE DURABILITY OF A COOLING TUBE IN A FIRE TUBE BOILER

BACKGROUND OF THE INVENTION

The present invention generally relates to methods and devices for cooling fluids, and more particularly to the construction and configuration of fire tube boilers and water tube boilers, and still more particularly to increasing the durability of cooling tubes used in such devices.

Many industrial processes employ high temperature heat exchangers, sometimes called fire tube boilers or water tube boilers, to remove heat from a fluid stream, either a gas or a liquid. The construction of these fire tube boilers has been a source of interest for many engineers, since the high temperatures typically experienced in these processes result in many equipment problems, such as corrosion, deterioration of materials by cracking, compromise of junctions between dissimilar materials, uneven expansion of materials in the equipment, and the like. Illustrative of these problems are processes that involve the removal of hydrogen sulfide gas from certain industrial processes.

Many industrial processes result in the production of hydrogen sulfide ($H_2S$), an odorous, corrosive, and highly toxic gas. Hydrogen sulfide is generally undesirable because of these qualities and also because it deactivates industrial catalysts. $H_2S$ is also commonly found in natural gas and at oil refineries, especially if the crude oil contains a lot of sulfur compounds. Because $H_2S$ is such an undesirable substance in these applications, industrial processes may typically include provisions to convert $H_2S$ to other non-toxic and less corrosive substances. One such method of converting $H_2S$ to elemental sulfur is well known in the art as the Claus Sulfur Recovery process.

After the $H_2S$ is separated from a host gas stream as, for example, by using amine extraction, it is fed to an apparatus supporting the Claus Sulfur Recovery Process, where it is converted in two separate steps. The first step involves partially oxidizing the $H_2S$ with ⅓ of the necessary oxygen in a reaction furnace at high temperatures, typically 1000° C.-1400° C. Sulfur is formed thereby, but the resulting gas comprises about ⅔ $H_2S$ and about ⅓ $SO_2$. This resulting gas is then passed through a water-cooled heat exchanger known in the art as a fire tube boiler, to remove some of the heat from the resulting gas. The second step involves reacting the remaining $H_2S$ and $SO_2$ at lower temperatures (about 200-350° C.) over a catalyst to make more sulfur. A catalyst is needed in the second step to help the components react with reasonable speed, but unfortunately the reaction does not go to completion even with the best catalyst. Thus two or three stages are used, with sulfur being removed between the stages, and multiple stages of the process may employ multiple fire tube boilers.

In a fire tube boiler used in the first step, the hot gasses pass directly through tubes suspended within a vessel containing water as the cooling medium. Fire tube boilers may be designed for vertical, inclined or horizontal orientations, with the preferred position being horizontal. A number of such tubes may be attached to tube sheets that make up the ends of a cylindrical vessel, so that the tubes are suspended within the cooling medium without touching one another. This structure allows the cooling medium to pass around and between the tubes, so that heat is transferred from the fluid passing through the tubes through the tube walls to the cooling medium by means of conduction and convection.

The high temperatures encountered in such applications, illustrated by the Claus process for example, have resulted in a number of problems for fire tube boilers. First, when the high temperature gas enters the relatively cool interior of a cooling tube, a phenomenon known as film boiling may occur on the exterior of the tube. In film boiling, the exterior surface of the cooling tube is heated rapidly, and a layer of steam is generated around the cooling tube. Thus, the water that would otherwise surround the tube is prevented from contacting the tube by the resultant steam layer so that the cooling water is not in direct contact with the exterior surface. At the high temperatures exhibited by the Claus process, for example, the water along this portion of the tube surface can vaporize and form a steam layer preventing the liquid water from contact with the tube. As a result, heat transfer from the tube exterior surface to the water occurs mainly through radiation, which is less efficient than conduction. Thus, film boiling along tube surface reduces the efficiency of the fire tube boiler and can increase the temperature of the tube wall to a damaging level.

A second common problem with many heat exchanging devices, such as fire tube boilers, is erosion, usually caused by the velocity of flow of the high temperature gas especially adjacent the ends of the tube and over the first few centimeters inside of the tube where the fluid flow may be turbulent. This problem may be exacerbated by the presence of foreign materials that may be entrained within the gas flow, such as soot or ash in some applications. Erosion necessitates the replacement of tubes, so that if erosion could be reduced, then the frequency of replacement would be reduced.

A third common problem is corrosion that can be caused by reaction of the gas with the interior surfaces of the tubes. When the fluid being cooled is $H_2S$, the formation of scale composed of iron sulfide has been observed on the interior tube walls. This problem may be solved by choosing tube materials that are non-reactive with the incoming gas, but other considerations such as resistance to high temperatures may outweigh the need for reduced corrosion. Furthermore, the junction between the tube and the tube sheet may be vulnerable to such corrosion problems.

A fourth problem that is closely associated with that of corrosion is the exhaustion of ductility of the tube material resulting from extreme swings of temperature within a very short distance. This repeated heating and cooling may result in cyclic strain accumulation of the tube structure or of the connective structure between the tube and the tube sheet, resulting in cracking, metal fatigue, or other types of damage.

The prior art is replete with examples of how the problem of attaching a tube end to a tube sheet is addressed, when used in the application of heat exchangers, boilers, flues, and the like. For example, U.S. Pat. No. 1,102,163, to Opperud, discloses an attachment method, wherein the tube end is inserted through the tube sheet and internally expanded to form a lip engaging the tube sheet and an opening with a slightly expanded portion sufficient to receive a cylindrical thimble inserted within the slightly expanded portion. A ring is then the tube sheet snugly between it and the lip. The method requires precise placement of the ring and expansion of the tube end to precisely capture the tube sheet. Care must be taken to ensure that the joint is snug so that the pressure of internal water does not seep through the opening between the tube and the tube sheet.

U.S. Pat. No. 3,317,222, to Maretzo, discloses insert constructions for tubes of heat exchangers that protect from deterioration the tube interiors and tube end portions of said tubes, as well as the regions where the tube end portions are welded to the tube sheet. The invention consists of a tube insert with a flared end, with the tube insert being inserted into a tube end that is welded in a hole of the tube sheet. The tube end has a circumferentially expanded portion that abuts the interior walls of a hole for a snug fit in the hole. The tube insert is inserted into the tube end, the flared end protecting the weld, so that a tapered end of the tube insert extends and tapers a distance into the tube. The portion of the tube insert adjacent to the expanded portion of the tube end is then expanded to form a pressure fitting against the interior of the tube end to hold the tube insert in place. However, the expanded portion of the tube insert presents ridges to an incoming flow of gas, which may cause unwanted turbulence in the gas stream and possible wear.

As can be seen, there is a need for a method for attachment of a tube end to a tube sheet in a fire tube boiler, which prevents or reduces film boiling, corrosion, and fatigue of the tube end. Furthermore, turbulence of the entering gas should also be reduced to promote improvement of the service life of the tube.

SUMMARY OF THE INVENTION

The invention provides an internal overlay for a cooling tube, where the internal overlay is formed as a layer of material applied about an interior surface of the cooling tube, the interior surface with an inner tube diameter, the layer having a first layer end spaced a distance from a first tube end of the cooling tube, the layer also having a second layer end that is distal from both the first layer end and the first tube end, the layer defining a channel extending from the first layer end to the second layer end, the channel with a channel wall having an inner channel diameter that continuously increases from the first layer end to the second layer end, the layer having an annular inner recess about the first end, the annular inner recess sized to receive a ferrule end of a ferrule having a bore therethrough, the bore having a bore wall, wherein the bore wall and the channel wall are continuous.

The invention also provides an apparatus for a cooling tube of a fire tube boiler in which the cooling tube has a tube end and an interior surface with an inner tube diameter. The apparatus comprises a ferrule with a first ferrule end, a second ferrule end, and a bore extending between the first ferrule end to the second ferrule end, the bore having a bore wall with an inner bore diameter, the second ferrule end sized for insertion into the tube end and extending within the cooling tube a distance from the tube end; and an internal overlay applied as a layer about the interior surface, the layer with a first layer end, a second layer end, and a channel extending from the first layer end to the second layer end, the first layer end spaced the distance from the tube end and extending distally from the tube end; the layer having a first layer end spaced a distance from a first tube end of the cooling tube, the channel having a channel wall with an inner channel diameter that continuously increases from the first layer end to the second layer end, the layer having an annular inner recess about the first layer end, the annular inner recess sized to receive the second ferrule end in abutting relationship when the ferrule end is inserted into the tube end; wherein the bore wall and the channel wall form a continuous surface having no turbulence-producing discontinuities.

The invention also provides a system for reducing turbulence in a hot fluid entering a cooling tube in a fire tube boiler and improving the operational life of the cooling tube, where the cooling tube has a first tube end inserted through a hole in a first tube sheet of the fire tube boiler for fixed attachment thereto, a second tube end inserted through a hole in a second tube sheet of the fire tube boiler for fixed attachment thereto, and an interior surface with a inner tube diameter that is constant, so that a cooling fluid circulates around the cooling tube. The system comprises a ferrule with a first ferrule end, second ferrule end, and a bore with a bore wall extending therebetween, the second ferrule end inserted within the first tube end, so that the ferrule is disposed to receive a hot fluid entering the first ferrule end and flowing in the direction of the second ferrule end through the bore; and an internal overlay applied as a layer a distance from the first tube end about the interior surface; the layer having a first layer end with an annular inner recess thereabout sized to receive the second ferrule end, a second layer end, and a channel with a channel wall diverging away from the first layer end towards the second layer end, wherein the channel wall at the first layer end is smoothly contiguous with the bore wall at the second ferrule end when the second ferrule end abuts the annular inner recess and when the cooling tube is at an operating temperature.

A method for reduction of film boiling in a cooling tube is also provided for a cooling with a first tube end, a second tube end, and an interior surface having a constant inner tube diameter. The method comprises the steps of fabricating an internal overlay about the interior surface as a layer that is spaced a distance from the first tube end, the layer having a first layer end with an annular inner recess thereabout, the layer internally diverging from the first layer end to a second layer end to provide a continuous transition from the first layer end to the interior surface; inserting a second ferrule end of a ferrule also with a first ferrule end into the first tube end, the second ferrule end sized to extend from the first tube end to be received in abutting relationship within the annular inner recess at the first layer end, such that a smooth transition is provided between the ferrule and the overlay; providing a cooling fluid about the cooling tube to remove heat therefrom; and allowing a hot fluid to flow from the first tube end to the second tube end through the ferrule and the internal overlay so that heat is removed from the hot fluid through the cooling tube to the cooling fluid. This method thus prevents film boiling of the cooling fluid along a portion of the cooling tube containing the ferrule and the overlay when the cooling tube is at an operating temperature.

These and other features, aspects, and advantages of the present invention will become better understood with reference to the following drawings, description, and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the current invention includes systems, devices, and methods for reducing turbulence within a hot fluid flowing through a cooling tube end and increasing the durability of the cooling tube. The invention includes a cooling tube with an internal, corrosion-resistant overlay positioned proximate the tube end so that it receives an end of a protective ferrule inserted into the tube end. The method of internally applying the internal overlay within the tube end is considered to be unique to the invention. The ferrule and internal overlay may be tapered from the ferrule end to the interior tube wall to provide a smooth flow path and smooth transition from the ferrule to the interior tube wall. The overlay may be fabricated with an annular inner recess, so that it smoothly receives and centers the end of the ferrule and eliminates any discontinuities between the ferrule and the overlay. This arrangement is designed to minimize turbulence so that higher flow rates may be permitted without causing film boiling on the outside of the tube. This arrangement further results in higher capacity and better reliability of the cooling tube.

The use of ferrules has been shown in the prior art to improve the conditions encountered at the tube ends. Ceramic ferrules for this purpose are manufactured by such manufacturers as Industrial Ceramics and Blasch Precision Ceramics. However, they do not provide an undisturbed flow path because of a discontinuity in the internal diameter of the ferrule-to-tube transition. While the inner end of such ferrules may be generally tapered, they necessarily have a blunted end, since further tapering would result in extremely thin ends that are prone to easy breakage. The invention allows the use of standard ferrules while reducing turbulence that occurs at the inner end of the ferrule.

When used in this disclosure, the terms "upstream" and "downstream" shall relate to the flow of a heated fluid, with "downstream" referring to the direction with or away from the flow and "upstream" referring to the direction against or towards the flow.

Figure 1:
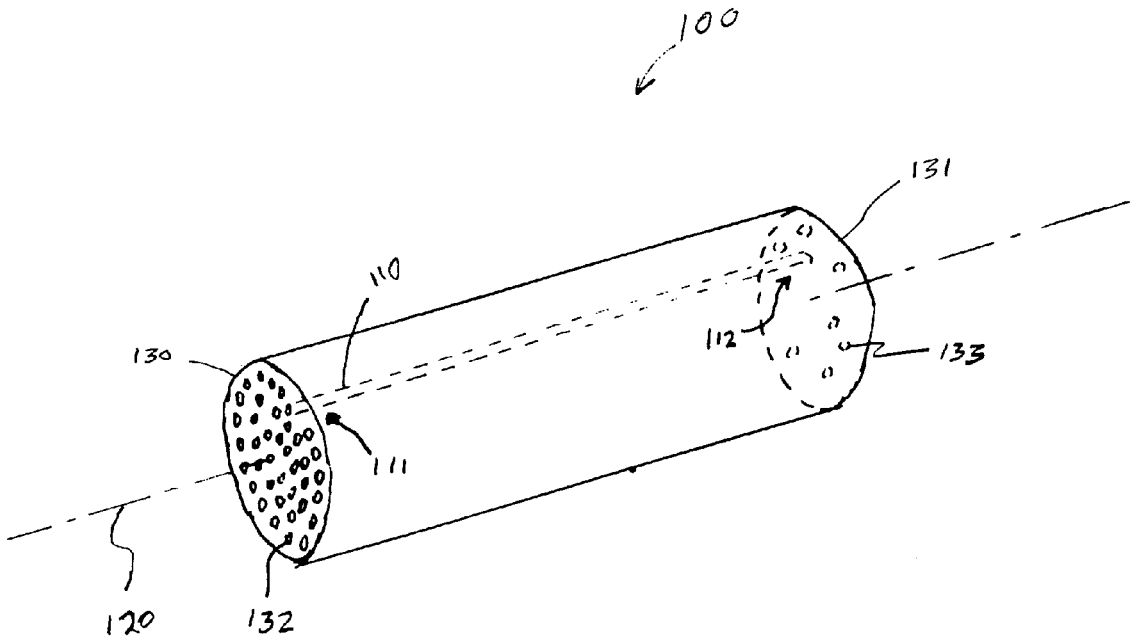
FIG. 1 shows a boiler and the orientation of a cooling tube with respect to the tube sheets covering the ends of the boiler, according to an embodiment of the invention.

Referring now to FIG. 1, a typical fire tube boiler 100 is shown with a cooling tube 110 oriented longitudinally and parallel to a central axis 120 of the fire tube boiler 100. Although the fire tube boiler 100 is shown in a horizontal orientation, it may also be oriented vertically or at any angle therebetween without departing from the scope of the invention. Generally a fire tube boiler 100 will have multiple cooling tubes 110, of which only one is shown in the drawing for clarity. Each end of the fire tube boiler 100 may be covered with a tube sheet 130, 131 having multiple holes 132, 133 sized to snugly receive the ends of the cooling tubes 110. The pair of holes in the tube sheets 130, 131 through which a cooling tube 110 is inserted may be coaxially aligned to maintain the cooling tube 110 in parallel relationship with the central axis 120. The cooling tubes 110 may be spaced apart to allow a cooling fluid such as water to circulate around and between the cooling tubes 110 to remove heat from the cooling tubes 110 by means of conduction. The cooling fluid thus heated may be removed from the fire tube boiler 100, recirculated through a heat removal means (not shown), and reintroduced to the fire tube boiler 100 for further heat removal. The details of such arrangements are well-known to the art and will not be discussed here.

Figure 2:
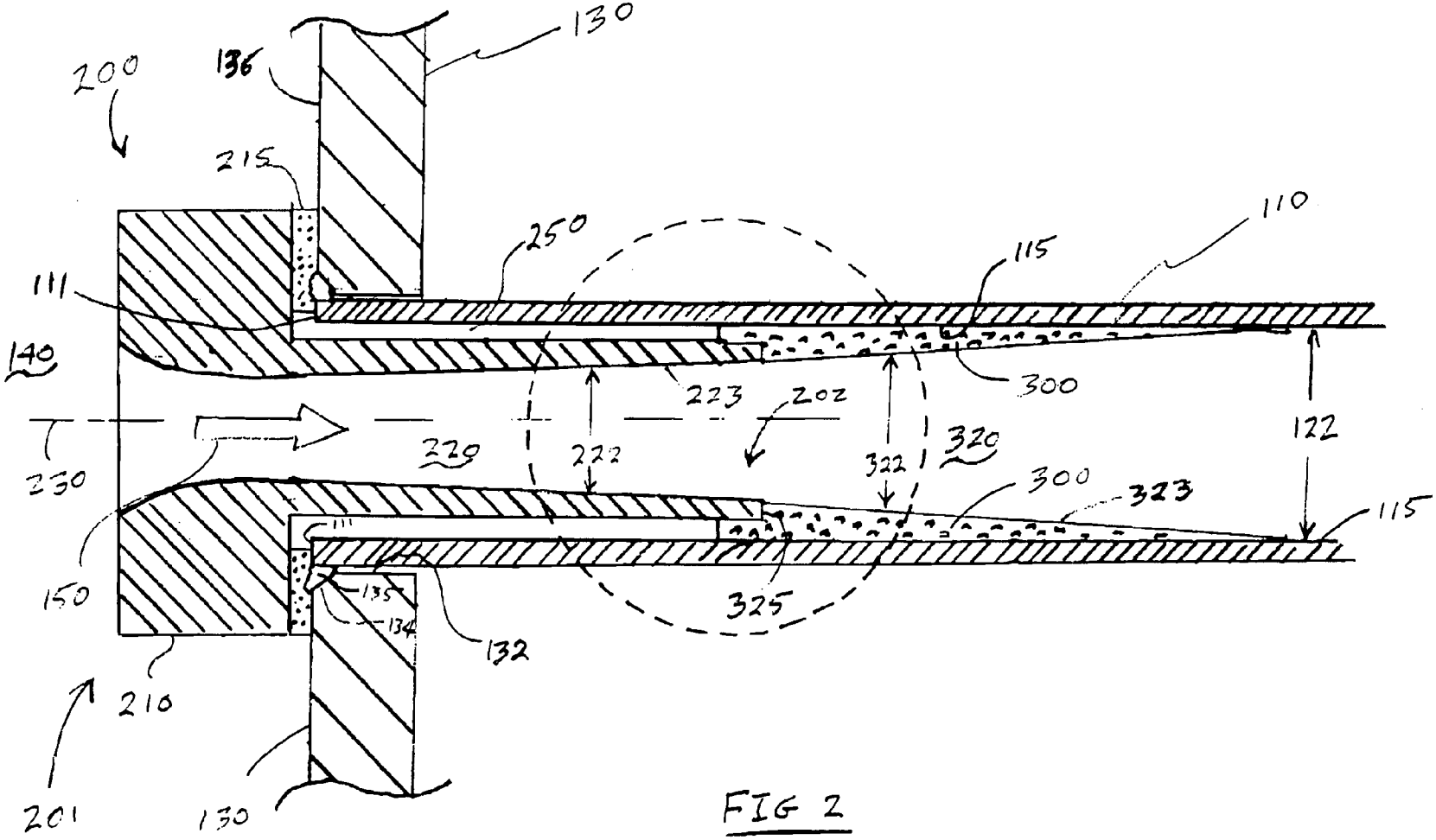
FIG. 2 shows a cross section a tube having a ferrule and weld arrangement as it is arranged during operation, according to an embodiment of the invention.

Referring now to FIG. 2, a cooling tube 110 is shown with a ferrule 200 and an internal overlay 300, according to an embodiment of the invention. The cooling tube 110 may have a first tube end 111 inserted through a hole 132 in the tube sheet 130 and a second tube end 112 inserted through a hole 133 in the tube sheet 131 (FIG. 1). The first tube ends 111 may be flush with the outer surface 136 of the tube sheet 130. The holes 132, 133 may have a slight chamfer 134 about their external circumferences in order to accept a weld 135 securely attaching the tube ends 111, 112 to the tube sheets 130, 131, respectively. The first tube ends 111 of the cooling tubes 110 may be exposed to a plenum 140 into which a heated fluid is introduced, so that the heated fluid is made to flow through the first tube ends 111 to the second tube ends 112, with the direction 150 of fluid flow being from the first tube end 111 to the second tube end 112.

The invention may provide a ferrule 200 for insertion within the first tube end 111 of a cooling tube 110. The ferrule 200 may have a first ferrule end 201 with a collar 210 thereabout and a second ferrule end 202 that is sized for insertion into the first tube end 111. The diameter of the collar 210 may be larger than the diameter of the hole 132, so that the second ferrule end 202 of the ferrule 200 may be inserted only a maximum distance within the first tube end 111. The ferrule 200 may be inserted through a gasket 215 having a diameter approximate that of the collar 210, with the hole in the gasket 215 having a diameter that is approximately that of the hole 132.

The second ferrule end 202 of the ferrule 200 may be wrapped with an insulating fabric 250 before insertion into the first tube end 111. This insulating fabric 250 may serve to snugly support the ferrule within the first tube end 111 and to insulate the ferrule from the cooling tube 110. It may be composed of materials such as alumina ($Al_2O_3$), and the like; one typical alumina material of this type is sold under the trademark of "Kaowool" by Thermal Ceramics Corporation, Augusta, Ga.

The ferrule 200 may have a bore 220 through the ferrule 200 and centered about a ferrule centerline 230, to allow a heated fluid to flow through the ferrule 200 from its first ferrule end 201 to its second ferrule end 202. The bore 220 may have a bore wall 223 with an inner diameter 222 that gradually increases from some point between its first ferrule end 201 to its second ferrule end 202, so that the bore wall 223 slopes outwardly in the direction towards the interior surface 115 of the cooling tube. The ferrule 200 may be fabricated of any suitable material that is able to withstand high temperatures associated with the particular industrial process in which the cooling tube is used. For example, in the Claus Sulfur Recovery process (discussed previously), it has been found that a ferrule composed of a ceramic material is suitable.

An internal overlay 300 may be fabricated as a band, or layer, of heat resistant material, having an first layer end and a second layer end, which is fixedly attached about the interior surface 115 of the cooling tube 110 to form a slightly restricted channel 320 therein with a channel wall 323 with inner diameter 322. The inner diameter 322 of the internal overlay 300 may increase in the downstream direction until it becomes identical to the inner diameter 122 of the cooling tube 110 at the second layer end of the internal overlay 300. The first layer end of the internal overlay 300 may have an inwardly opening, annular inner recess 325 thereabout to receive the second ferrule end 202 of the ferrule 200, so that a smooth transition is made between the bore 220 of the ferrule 200 and the channel 320 of the internal overlay 300, so that the bore wall 223 is contiguous with the channel wall 323. The inner diameter 222 of the bore 220 at the second ferrule end 202 of the ferrule 200 may be the same as the inner diameter 322 of the channel 320 at the first layer end of the internal overlay 200.

The internal overlay 300 may be composed of a material that is corrosion resistant with respect to the heated fluid flowing through the cooling tube. In the case of the Claus Sulfur Recovery process (discussed previously), this material may be comprised of an alloy of iron, chromium, and aluminum, and deposited and formed along the inner wall of the cooling tube 110 as a weld overlay. Such alloys are made by Kanthal, a division of the Sandvik Group, and sold under the trademark Kanthal APM. Alloys with different compositions may also be used as a design choice depending upon the heated fluid that flows through the cooling tube, but such alloys may have the common property of being capable of being deposited through a weld overlay process. In another embodiment of the invention, the internal overlay may be fabricated as a cylindrical plug with the appropriate features, inserted into the first cooling tube end, positioned a selected distance from the first tube end to enable it to receive the ferrule 200 within its annular inner recess 325, and fixedly attached to the internal wall of the cooling tube as by welding.

When the internal overlay 300 is fabricated as a weld overlay according to the invention, the internal overlay 300 may be deposited along the interior surface 115 of a cooling tube 110 by using a standard Gas Tungsten Arc Welding (GTAW) process, which uses a tungsten electrode that is not consumed by the welding process and a wire composed of the alloy material. The wire of alloy material may be fed through the GTAW welding head that is inserted into the first tube end 111. The welding head may be configured for both rotation around the interior surface 115 and translation upstream and downstream within the cooling tube 110, so that the alloy may be deposited and built up within the cooling tube 110 according to the profile described herein. Afterwards, the channel 320 and annular inner recess 325 of the internal overlay 300 may be machined and polished according to the dimensions and tolerances that are appropriate for the particular application.

Figure 3:
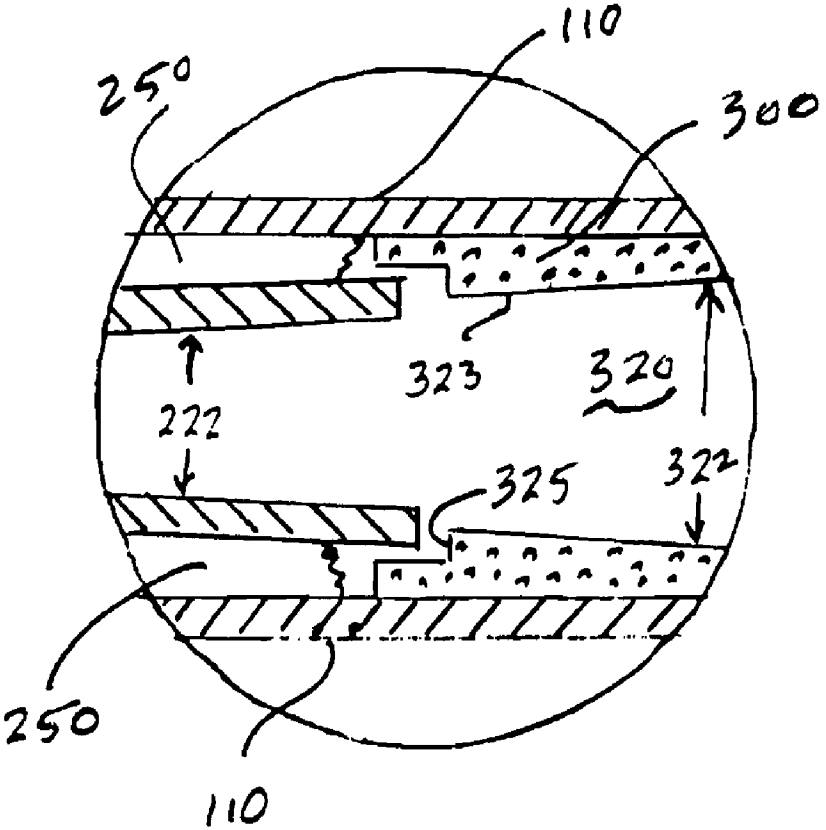
FIG. 3 shows a detail of the orientation of the ferrule with the internal weld when the tube is assembled, according to an embodiment of the invention.

It should be understood that the proceeding discussion described the configuration of the cooling tube 110, the ferrule 200, and the internal overlay 300 during operational use and at the operating temperature of the apparatus. However, thermal expansion of these components should be taken into account so that a smooth transition may be achieved between the ferrule 200 and the internal overlay 300. Referring now to FIG. 3, a portion of FIG. 2 is shown when the apparatus is at ambient temperature, which is normally much less than the operating temperature. As can be seen, the ferrule 200 will thermally expand when the temperature is increased to operating temperature, according to the coefficient of expansion of the ceramic material comprising the ferrule 200. This expansion will be both longitudinally, in which case the end of the ferrule 200 lengthens, and circumferentially, in which case the outer diameter of and inner diameter 222 of the ferrule 200 increases.

For example, at the operating temperatures for the Claus Sulfur Recovery process, i.e. about 1000° C.-1400° C., a ceramic ferrule may be used, which has a downstream end that is about 6"-12" long. At operating temperature, the length of the second ferrule end 202 has been observed to lengthen by approximately 0.125". Therefore it may be necessary to provide a gap between the downstream end of the ferrule and the internal overlay so that thermal expansion will close the gap and cause the downstream end to seat snugly within the annular inner recess of the internal overlay.

The apparatus described by the invention disclosed herein thus may illustrate a method for the reduction of film boiling in a cooling tube 110. Cooling tubes of the nature described herein may be used to allow a hot fluid flowing through the cooling tube 110 from a first tube end 111 to a second tube end 112 to be cooled by a cooling fluid flowing about the cooling tube 110 by removing heat conducted through the interior surface 115 of the cooling tube 110 to the outer surface of the cooling tube 110 by convectively transferring the heat to the cooling fluid. The method of the invention may provide a smooth transition of the hot fluid into the cooling tube 110 at the first tube end 111 so that turbulence is reduced and the sudden temperature gradient between the temperature of the hot fluid and the temperature of the cooling fluid is similarly reduced.

In an embodiment of the invention, a method is provided for such reduction of turbulence and temperature. First, an internal overlay 300 may be fabricated about the interior surface 115 of the cooling tube 110 as a layer with a first layer end and a second layer end. The first layer end may be spaced a distance from the first tube end 111 to allow a transitional device such as a ferrule 200 to be inserted into the first tube end 111 to receive the hot fluid. The first layer end may be provided with an annular inner recess 325 thereabout to receive the transitional device. The layer may diverge internally from the first layer end to the second layer end to provide a continuous transition to the interior surface 115.

Next, a second ferrule end 202 of a ferrule 200 may be inserted into the first tube end 111 to provide a transition from the first tube end 111 to the internal overlay 300. The ferrule may be sized to internally diverge from a first ferrule end 201 to the second ferrule end 202 and the second ferrule end 202 sized to be received in abutting relationship within the annular inner recess 325 at the first layer end, so that a smooth transition is provided between the bore wall 223 of the ferrule 200 and the internal overlay 300.

Next, a cooling fluid may be disposed about the cooling tube 110 and moved over the outer surface of the cooling tube 110 in order to remove heat that may radiate outwardly from the cooling tube 110.

Finally, a hot fluid may be allowed to flow from the first tube end 111 to the second tube end 112 through the ferrule 200 and the internal overlay 300 so that heat is removed from the hot fluid through the cooling tube 110 to the cooling fluid. The positioning of the ferrule 200 and the internal overlay 300 at the portion of the cooling tube 110 where the hot fluid initially enters may thus prevent film boiling of the cooling fluid along that portion of the cooling tube 110 containing the ferrule 200 and the internal overlay 300 when the cooling tube 110 is at an operating temperature.

As can be seen, the invention provides an apparatus for reducing turbulence in a hot fluid entering a cooling tube, thereby reducing erosion and improving heat transfer, and extending the operational life of the cooling tube by reducing the temperature gradient between the hot fluid and the cooling medium, thereby reducing the chances for thermal fatigue and cracking of the tube end. It should be understood, of course, that the foregoing relates to exemplary embodiments of the invention and that modifications may be made without departing from the spirit and scope of the invention as set forth in the following claims.

I claim:

1. A method for reduction of film boiling in a cooling tube having a first tube end, a second tube end, and an interior surface with an inner tube diameter that is constant, the method comprising the steps of:

fabricating an internal overlay about the interior surface as a layer that is spaced a distance from the first tube end, the layer having a first layer end with an annular inner recess thereabout, the layer internally diverging from the first layer end to a second layer end to provide a continuous transition from the first layer end to the interior surface;

inserting a second ferrule end of a ferrule also with a first ferrule end into the first tube end, the second ferrule end sized to extend from the first tube end to be received in abutting relationship with the annular inner recess at the first layer end, wherein a smooth transition is provided between the ferrule and the overlay;

providing a cooling fluid about the cooling tube to remove heat therefrom; and allowing a hot fluid to flow from the first tube end to the second tube end through the ferrule and the internal overlay so that heat is removed from the hot fluid through the cooling tube to the cooling fluid;

wherein the ferrule and the overlay prevent film boiling of the cooling fluid along a portion of the cooling tube containing the ferrule and the overlay when the cooling tube is at an operating temperature.

* * * * *

UNITED STATES PATENT AND TRADEMARK OFFICE

CERTIFICATE OF CORRECTION

PATENT NO. : 7,574,981 B1
APPLICATION NO. : 11/543572
DATED : August 18, 2009
INVENTOR(S) : Clinton J. Schulz It is certified that error appears in the above-identified patent and that said Letters Patent is hereby corrected as shown below:

Column 2, line 55, after "then" insert --inserted within the thimble and expanded against the thimble and the tube wall to form a raised circumferential area along the outside of the tube, which captures--

Signed and Sealed this

Third Day of November, 2009

David J. Kappos

David J. Kappos
*Director of the United States Patent and Trademark Office*